United States Patent [19]

Kennedy

[11] Patent Number: 4,978,093

[45] Date of Patent: Dec. 18, 1990

[54] PURSE HANGER

[76] Inventor: Samuel S. Kennedy, 3730 Briarwood Ave., Las Vegas, Nev. 89121

[21] Appl. No.: 182,918

[22] Filed: Apr. 18, 1988

[51] Int. Cl.[5] ..... A47B 96/06

[52] U.S. Cl. ..... 248/205.1; 248/304; 248/914

[58] Field of Search ..... 248/205.1, 215, 304, 248/301, 303, 339; 108/28, 30; 24/532, 134 KB, 134 R, 570, 571

[56] References Cited

U.S. PATENT DOCUMENTS

| | | | |
|---|---|---|---|
| 514,222 | 2/1894 | Hall | 248/215 |
| 600,599 | 3/1898 | Slattery | 248/215 X |
| 710,477 | 10/1902 | Littell | 248/215 X |
| 797,614 | 8/1905 | Schipkowsky . | |
| 980,162 | 12/1910 | Meyer | 248/215 X |
| 1,133,209 | 3/1915 | Wolke | 248/215 X |
| 1,361,056 | 11/1919 | Hickman | 248/215 O |
| 1,725,508 | 8/1929 | Clifford | 248/1 |
| 1,856,847 | 5/1932 | Gates | 248/215 V X |
| 1,944,610 | 12/1919 | Person | 24/328 O |
| 2,460,640 | 8/1945 | Jensen | 24/328 O |
| 2,565,719 | 6/1922 | Church | 248/215 |
| 2,631,803 | 6/1950 | Meyers | 248/215 |
| 2,692,108 | 6/1950 | Neivert | 248/215 |
| 2,968,077 | 5/1959 | Miller | 28/328 O |
| 3,240,463 | 3/1966 | Cook | 248/215 X |
| 4,027,842 | 6/1947 | Mittleman | 248/215 X |
| 4,387,873 | 6/1983 | Pavlo | 248/215 X |
| 4,397,253 | 8/1983 | Uecker | 24/134 KB X |
| 4,716,630 | 1/1988 | Skyba | 24/134 KB X |

*Primary Examiner*—J. Franklin Foss

[57] ABSTRACT

A purse hanger comprises a connecting member with a rigid flange at one end to secure the purse hanger to a table and with a hook or other retaining means at the other end to hold a purse. The purse hanger is designed to be used with a gaming table that has a padded surface and a cushioned raised rim that rests on the edge portion of the gaming table. The connecting member conforms to the shape of the exterior surface of the raised rim and the rigid flange is slidably mounted between the top of the table surface and the bottom of the raised rim.

An alternate embodiment of the purse hanger has a rigid tapered flange with a rigid hook attached directly thereto which is particularly useful for purses with long straps.

1 Claim, 4 Drawing Sheets

FIGURE 1.
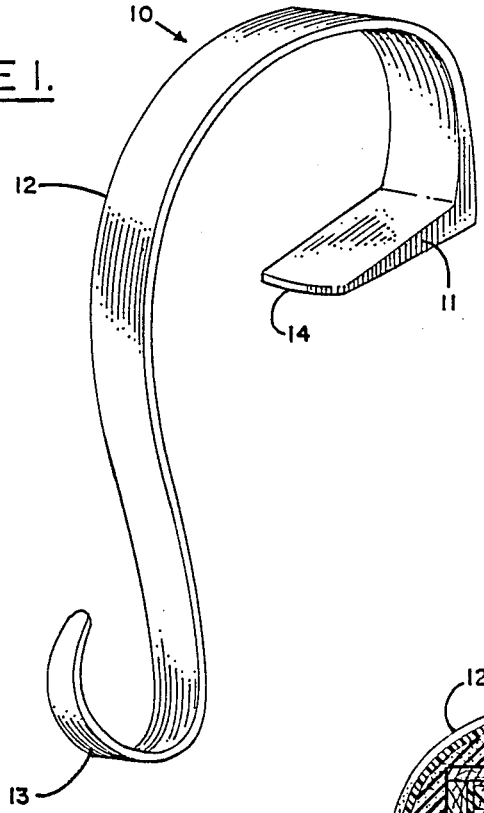
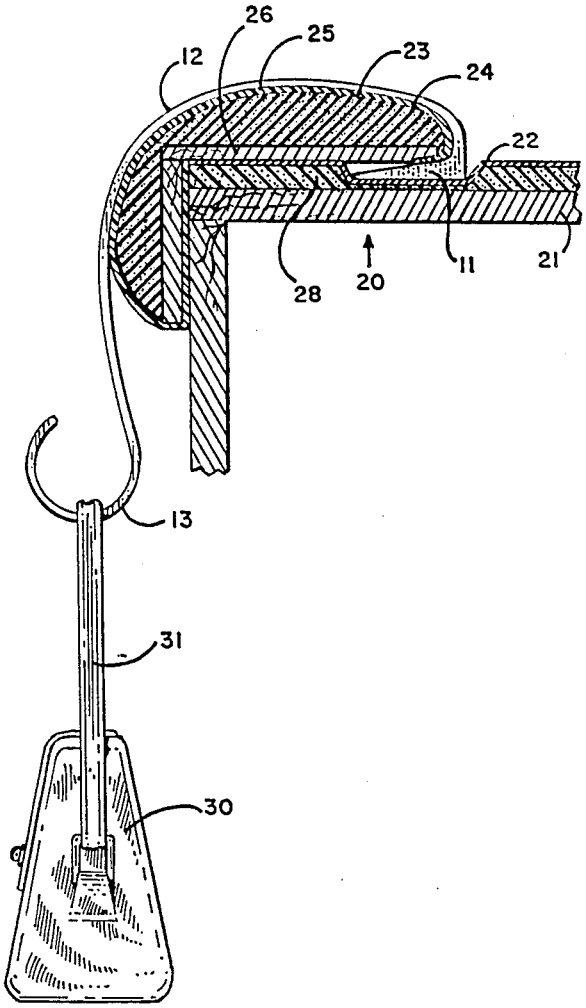
FIGURE 2.

PURSE HANGER

BACKGROUND OF THE INVENTION

One of the recurring problems that people have is what to do with a purse when seated at a table. If the purse is placed in the lap, then the mobility of the person holding the purse is limited. Laying the purse on the table prevents optimal utilization of the table space. Placing the purse on the floor under the person's seat increases the risk of having the purse stolen or even left behind when the person leaves the table.

These problems are particularly troublesome when a person is seated at a gaming table, such as a 21 table. The surface of the table is completely utilized for the playing of the game of 21. Because of the possibility of cheating, purses are not permitted on the table surface. Seating space is limited and it is just not convenient to place the purse in the lap of the player. Laying the purse under the table or even hanging the purse on the back of the chair is risky because of the possibility of purse snatching.

SUMMARY OF THE INVENTION

An object of the present invention is to provide a purse hanger that attaches easily to a gaming table to provide a safe convenient storage place for a purse. The connecting body member of the purse hanger fits the shape of the rim of the table. A rigid attachment flange holds the purse hanger to the table. A purse retaining device provides a means for hanging a purse from the purse hanger.

The invention can also be used with articles other than purses, such as hats, coats, shopping bags, umbrellas and the like.

BRIEF DESCRIPTION OF THE DRAWINGS

FIG. 1 shows the purse hanger of the present invention.

FIG. 2 shows the purse hanger of the present invention in use attached to the rim of a gaming table.

DESCRIPTION OF THE PREFERRED EMBODIMENT

Figure 3:
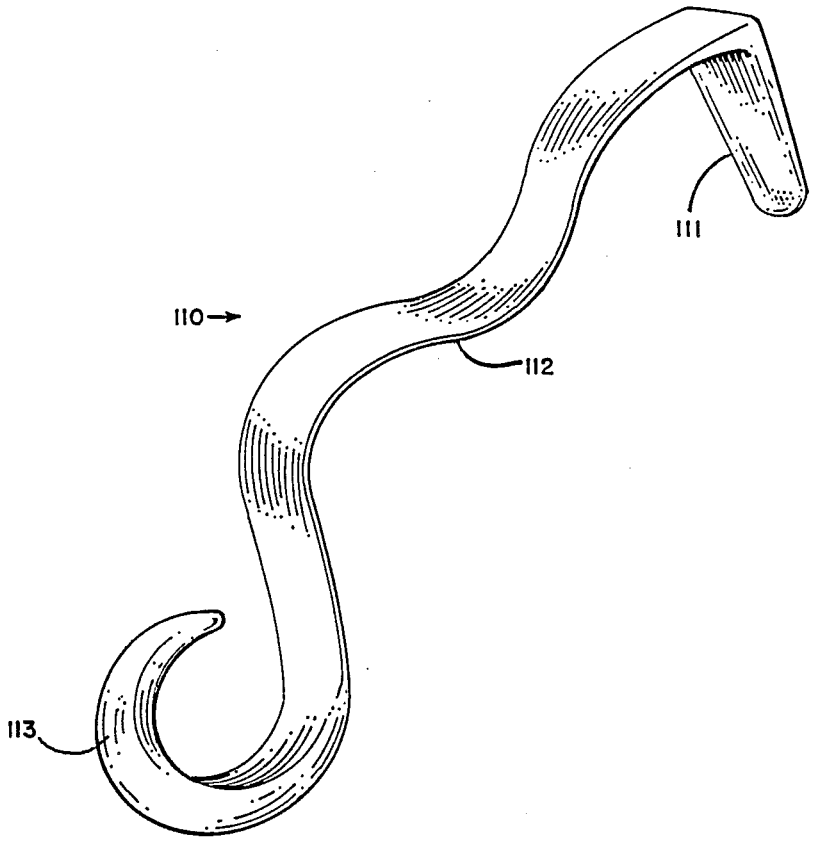
FIG. 3 shows of an alternate embodiment of the purse hanger of the present invention.

The purse hanger of the present invention is shown generally at 10 in FIG. 1. Table attachment means comprising a generally rigid flange 11 is provided at one end of the hanger 10. Purse retaining means comprising a rigid hook 13 comprising a generally rigid upwardly opening arcuate support member is formed at the opposite end of the hanger 10. A connecting member 12 connects the flange portion 11 and the hook portion 13 and comprises the rest of hanger 10. The flange 11 may be provided with a slight taper, becoming decreasingly thinner in cross-section toward the end 14 of the flange 11. Preferably, the flange 11, connecting member 12 and hook 13 are all molded as a single piece, although alternatively each part may be made separately and then joined together using conventional joining means. When not in use as a purse hanger, the connecting member 12 has the curved shape of the table rim with which it is designed to be used as shown in FIG. 1.

FIG. 2 shows the hanger 10 used to hang a purse 30 from a gaming table 20. A conventional gaming table is shown at 20. A wooden table base 21 has a flat horizontal surface which is covered with a layer of padding material 28, preferably foam rubber which in turn is covered with a thin layer of felt 22. The corner or edge portion of the table is provided with a raised cushioned rim member 23 that serves to pad the corner of the table. Rim member 23 has an L-shaped bottom to correspond to the L-shaped corner of the table and merely rests by gravity on the table. If the corner of the table is not L-shaped, then the bottom of the rim member 23 will be shaped to conform to the shape of the corner of the table 20. Rim member 23 is made of spongy material 24, such as foam rubber, covered with a leatherlike protective layer 25. To provide shaping and support to the rim member 23, a generally L-shaped base member 26, preferably made of wood, is provided along the bottom of the rim member 23. In a conventional gaming table, the top of the rim member 23 is formed as a gently curved surface to provide a comfortable area where players may lean while gambling. The rigid flange 11 of the hanger 10 slides under the edge of rim member 23 as shown in FIG. 2. The slight cross-sectional taper of the flange 11 facilitates the sliding of the flange 11 into the space between the bottom edge of the rim member 23 and the top of the table 20. Because the top of the table 20 has a padded layer 28 made of a spongy material, the padded layer 28 will slightly deform or compress to permit the rigid flange 11 to slide in between the raised rim member 23 and the table 20 as shown in FIG. 2. The connecting member 12 of the hanger 10 is shaped to fit around the rim member 23 and to conform to the shape of the outer surface of the rim member 23. The strap 31 of the purse is simply hung over the hook 13 at the end of the hanger 10. The weight of the purse 30 hung on hook 13 helps hold the hanger 10 to the table 20. While the length of the connecting member 12 may vary depending upon its intended application, it is preferably at least ½", and not more than about 8" in length, and is most preferably about 5–6"in length.

FIG. 3 shows an alternate embodiment of the purse hanger of the present invention. The purse hanger 110 has a rigid flange 111 and a rigid hook 113 similar to the flange and hook shown in FIG. 1. The connecting member 112, however, is a thin flexible piece designed to conform to the shape of a table or other supporting surface to which the purse hanger 110 is attached. The flexibility of connecting member 112 permits the purse hanger 110 to be adaptable to a curvelinear table edge surface such as that shown in FIG. 2 as well as a square, polygonal or any other shaped table edge surface.

Both purse hanger 10 and purse hanger 110 can be molded in a unitary piece. Preferably a high strength plastic, such as Hytrel made by Dupont, is used, although other materials, such as metal, may be utilized as will be apparent to those skilled in the art.

Figure 4:
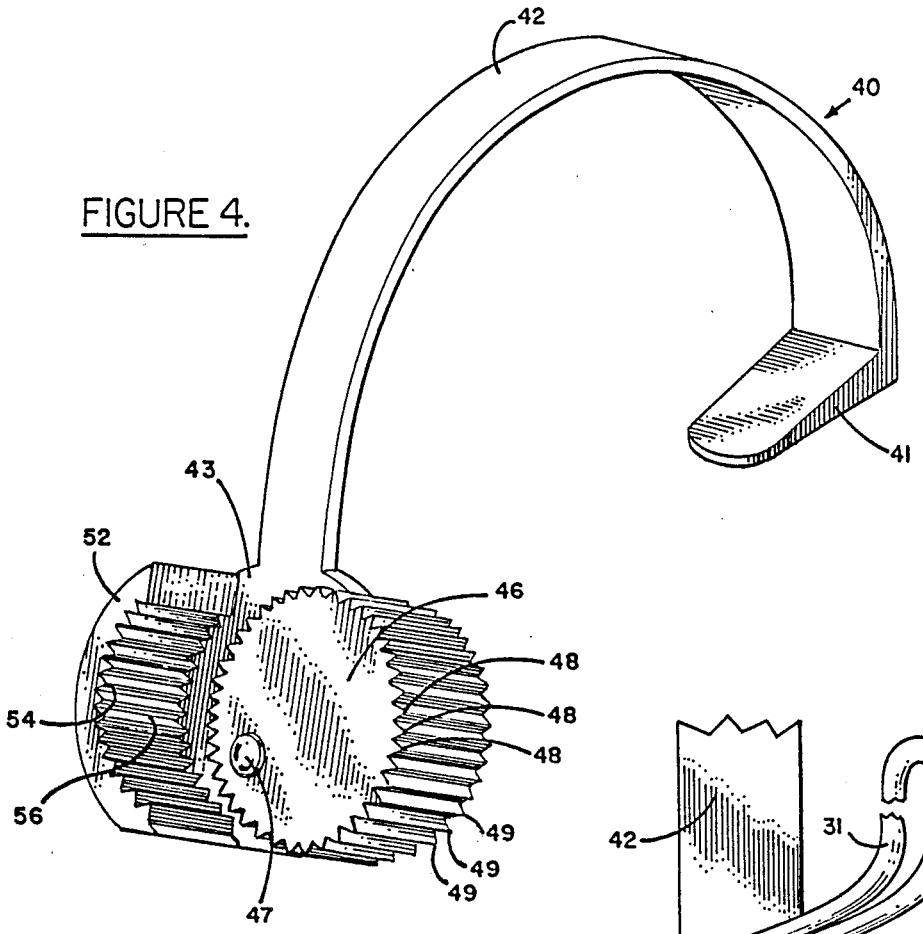
FIGS. 4 and 5 show an alternate embodiment of a supporting surface for the straps of a purse.
Figure 5:
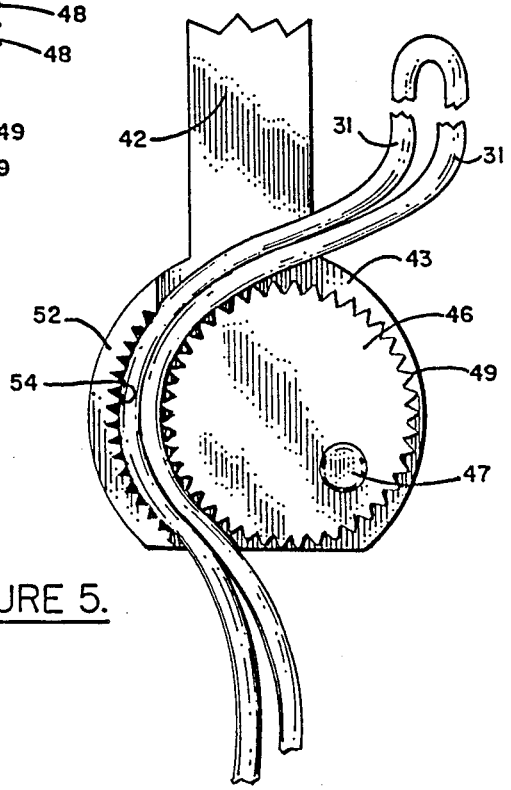

FIGS. 4 and 5 show an alternate embodiment of the present invention wherein an eccentrically-mounted wheel rotates to grip the straps of a purse against a cooperating gripping surface. Referring to FIG. 4, the hanger 40 includes a rigid flange 41 and a connecting member 42 which correspond to the flange 11 and connecting member 12 shown in FIGS. 1–2.

Strap gripping means are provided at the end of the connecting member 42 opposite from the flange 41. The strap gripping means comprise a generally flat base portion 43 having a rotatable gripping member 46 mounted thereon. The gripping member 46 comprises a generally circular wheel or disk rotatably eccentrically mounted on a pin 47 which extends perpendicularly outwardly from base portion 43. A plurality of teeth 49 formed by uniformly spaced transverse grooves 48 in the disk periphery provide a convex gripping surface.

A curved gripping flange 52 molded integrally with base portion 43 extends perpendicularly therefrom, and has approximately the same thickness as the disk 46. A plurality of uniformly spaced teeth 54 are formed along the concave interior surface 56 of the gripping flange 52. Both sets of teeth 49 and 54 cooperate to form gripping surfaces to preclude slippage of the straps of a purse held in the gripping means.

When a purse strap 31 is inserted into the gripping means as shown in FIG. 5, the disk 46 is rotated in a plane parallel to the plane of the base portion 43 about the pin 47 from the retracted position shown in FIG. 4 to the gripping position shown in FIG. 5, thus retaining the purse strap 31 without slippage. Due to the eccentric rotatable mounting of the disk 46, the weight of the purse pulling down on the purse straps 31 biases the disk 46 toward the gripping flange 52 to grip the purse straps securely.

It is not necessary to have peripheral teeth on the cooperating gripping surfaces as long as sufficient friction is created to retain the purse straps in place. A serrated or roughened surface can be adequate, or the gripping surfaces can be coated with or fabricated from a non-slip material, such as an elastomer.

Figure 6:
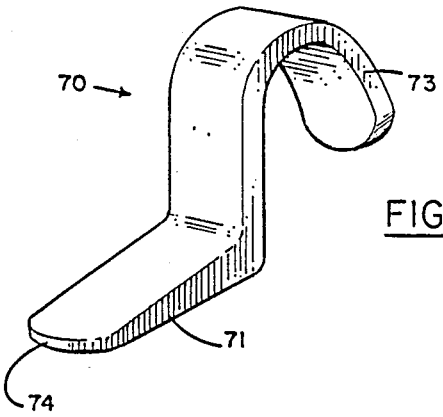
FIGS. 6 and 7 show a further embodiment of a purse hanger of the present invention.
Figure 7:
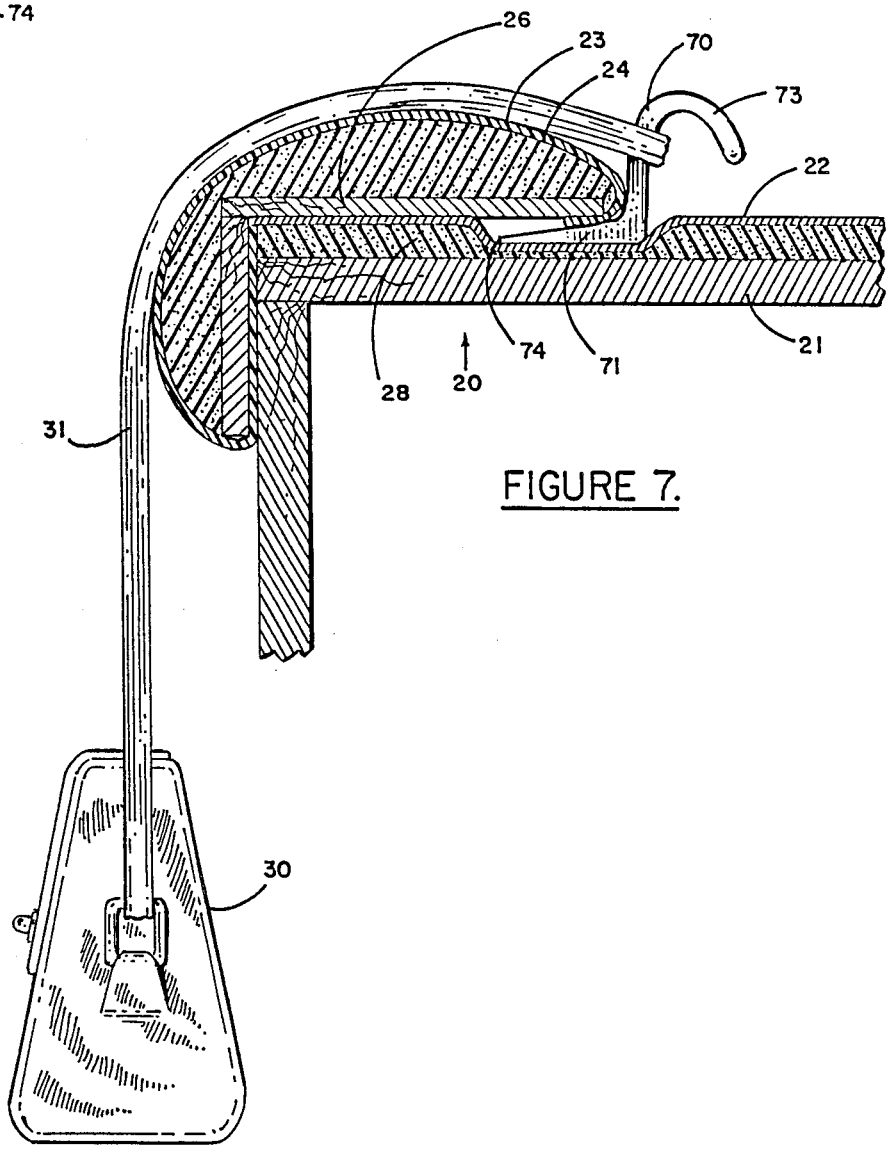

FIGS. 6 and 7 show a further embodiment of a purse hanger of the present invention. The purse hanger 70 has table attachment means comprising a generally rigid flange 71 that is tapered and becomes decreasingly thinner in cross-section toward the end 74 of the flange 71. Purse retaining means comprising a generally rigid hook portion 73 is attached directly to the flange 71. Preferably, the flange 71 and the hook 73 are all molded as a single piece, although alternatively each part may be made separately and then joined together using conventional joining means.

As shown in FIG. 7, the purse hanger 70 is designed so that the flange 71 slides under the edge of rim member 23 and slightly deforms or compresses the padded layer 28 of the top of the table 20. The hook 73 is attached to the flange 71 at an angle of approximately 90° so that the hook 73 projects upwardly from the top of the table 20. This orients the curve of the hook 73 to receive the straps of a purse as shown in FIG. 7. The purse hanger 70 is of compact size and can easily be carried in a player's purse until the player is ready to sit down at a table. The purse hanger 70 quickly attaches to the table and is particularly useful with purses that have long straps 31.

While the terms "rigid" and "flexible" as used herein are incapable of precise definition, they are intended to describe properties which enable the device of the present invention to function for its intended purpose, and will be clear to one having ordinary skill in the art. The rigid flange 11 is sufficiently stiff so that it is easily inserted into the space between the surface of the table 21 and the underside of the rim member 23 and will hold the purse hanger 10 in place. Likewise, the rigid hook 13 is sufficiently stiff so that it will hold a purse 30 and not deform under the weight of the purse. Also, the strap gripping means shown in FIGS. 4–5 can be used with the flexible connecting member 112 shown in FIG. 3.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

I claim:

1. An article hanger comprising:

(a) flexible connecting means for conforming the shape of the hanger to the shape of the structure to which the article hanger is applied, (b) a flange member mounted at one end of the connecting means for securing the article hanger to the structure to which the article hanger is applied, said flange member is tapered decreasingly thinner in cross-section toward its end, and (c) article retaining means at the opposite end of the connecting means for hanging an article therefrom, said article retaining means comprising:

(1) a base portion, (2) a gripping flange extending outwardly from the base portion and having a concave first gripping surface with a plurality of teeth means, and (3) a generally circular disk having a plurality of teeth means on its peripheral second gripping surface and rotatably mounted on the base portion, said circular disk being movable between a first retracted position and a second gripping position whereby an article to be retained may be hung between the first and second gripping surfaces.

* * * * *